US010626487B2

(12) United States Patent
Ohtake et al.

(10) Patent No.: US 10,626,487 B2
(45) Date of Patent: Apr. 21, 2020

(54) AUSTENITIC HEAT-RESISTANT CAST STEEL AND METHOD FOR MANUFACTURING THE SAME

(71) Applicants: Kazumi Ohtake, Toyota (JP); Takamichi Ueda, Toyota (JP); Yoshikazu Genma, Toyota (JP); Takahiro Sato, Chiryu (JP); Hiroshi Fujii, Chiryu (JP)

(72) Inventors: Kazumi Ohtake, Toyota (JP); Takamichi Ueda, Toyota (JP); Yoshikazu Genma, Toyota (JP); Takahiro Sato, Chiryu (JP); Hiroshi Fujii, Chiryu (JP)

(73) Assignees: TOYOTA JIDOSHA KABUSHIKI KAISHA, Toyota-shi, Aichi-ken (JP); AISIN TAKAOKA CO., LTD., Toyota-shi, Aichi-ken (JP)

( * ) Notice: Subject to any disclaimer, the term of this patent is extended or adjusted under 35 U.S.C. 154(b) by 628 days.

(21) Appl. No.: 14/778,352

(22) PCT Filed: Mar. 18, 2014

(86) PCT No.: PCT/IB2014/000380

§ 371 (c)(1),
(2) Date: Sep. 18, 2015

(87) PCT Pub. No.: WO2014/147463

PCT Pub. Date: Sep. 25, 2014

(65) Prior Publication Data

US 2016/0068936 A1 Mar. 10, 2016

(30) Foreign Application Priority Data

Mar. 22, 2013 (JP) ..... 2013-059253
Nov. 8, 2013 (JP) ..... 2013-231680

(51) Int. Cl.
*C22C 38/40* (2006.01)
*C22C 38/42* (2006.01)
(Continued)

(52) U.S. Cl.
CPC ..... *C22C 38/42* (2013.01); *B22D 23/00* (2013.01); *C21D 6/004* (2013.01); *C21D 6/005* (2013.01);
(Continued)

(58) Field of Classification Search
CPC ..... C21D 2211/001
See application file for complete search history.

(56) References Cited

U.S. PATENT DOCUMENTS 2,246,445 A * 6/1941 Kiefer ..... C21D 6/004 148/607
5,194,220 A 3/1993 Takahashi et al.
(Continued)

FOREIGN PATENT DOCUMENTS

GB 936872 A 9/1963
JP 05-005161 A 1/1993
(Continued)

*Primary Examiner* — Jessee R Roe
*Assistant Examiner* — Jophy S. Koshy
(74) *Attorney, Agent, or Firm* — Sughrue Mion, PLLC

(57) ABSTRACT

An austenitic heat-resistant cast steel includes 0.1% to 0.6% by mass of C, 1.0% to 3.0% by mass of Si, 0.5% to 1.5% by mass of Mn, 0.05% by mass or less of P, 0.05% to 0.3% by mass of S, 9% to 16% by mass of Ni, 14% to 20% by mass of Cr, 0.1% to 0.2% by mass of N, and the balance of iron and inevitable impurities, in which a matrix structure of the austenitic heat-resistant cast steel is composed of austenite crystal grains, and a ferrite phase is dispersed and interposed between the austenite crystal grains so as to cover the austenite crystal grains.

4 Claims, 8 Drawing Sheets

(51) Int. Cl.

| | |
|---|---|
| ***C21D 6/00*** | (2006.01) |
| ***C22C 38/00*** | (2006.01) |
| ***C22C 38/02*** | (2006.01) |
| ***C22C 38/04*** | (2006.01) |
| ***C22C 38/60*** | (2006.01) |
| ***C22C 38/34*** | (2006.01) |
| ***B22D 23/00*** | (2006.01) |

(52) U.S. Cl.

CPC ..... *C21D 6/008* (2013.01); *C22C 38/001* (2013.01); *C22C 38/002* (2013.01); *C22C 38/02* (2013.01); *C22C 38/04* (2013.01); *C22C 38/34* (2013.01); *C22C 38/40* (2013.01); *C22C 38/60* (2013.01); *C21D 2211/001* (2013.01); *C21D 2211/005* (2013.01)

(56) References Cited

U.S. PATENT DOCUMENTS

| | | | | |
|---|---|---|---|---|
| 2007/0217941 | A1* | 9/2007 | Hayashi | C22C 38/001 420/38 |
| 2011/0000200 | A1 | 1/2011 | Kawabata | |

FOREIGN PATENT DOCUMENTS

| | | | |
|---|---|---|---|
| JP | 06-256908 | A | 9/1994 |
| JP | 07-113143 | A | 5/1995 |
| JP | 07-228950 | A | 8/1995 |
| WO | 2009/104792 | A1 | 8/2009 |

* cited by examiner

AUSTENITIC HEAT-RESISTANT CAST STEEL AND METHOD FOR MANUFACTURING THE SAME

BACKGROUND OF THE INVENTION

1. Field of the Invention

The present invention relates to an austenitic heat-resistant cast steel, in particular, to an austenitic heat-resistant cast steel excellent in the thermal fatigue characteristics.

2. Description of Related Art

An austenitic heat-resistant cast steel has been used for exhaust system parts and so on for a vehicle such as an exhaust manifold, a turbine housing and the like. Such components are exposed to a high temperature and severe use environment. In order for the components to have excellent thermal fatigue characteristics, it is considered necessary to be excellent in the high-temperature strength characteristics and toughness from room temperature to a high temperature.

From such a viewpoint, for example, Japanese Patent Application Publication No. 07-228950 (JP 07-228950 A) proposes an austenitic heat-resistant cast steel that includes 0.2 to 0.6% by mass of C, 2% by mass or less of Si, 2% by mass or less of Mn, 8 to 20% by mass of Ni, 15 to 30% by mass of Cr, 0.2 to 1% by mass of Nb, 1 to 6% by mass of W, 0.01 to 0.3% by mass of N, and the balance of Fe and inevitable impurities. Such a heat-resistant cast steel is obtained in such a manner that a molten metal obtained by melting a material containing the components described above as a starting material is heat-treated under heating condition of 1000° C. and 2 hours to remove residual stress after casting.

Further, Japanese Patent Application Publication No. 06-256908 (JP 06-256908 A) proposes a heat-resistant cast steel that has a composition consisting of 0.20 to 0.60% by mass of C, 2.0% by mass or less of Si, 1.0% by mass or less of Mn, 4.0 to 6.0% by mass of Ni, 20.0 to 30.0% by mass of Cr, 1.0 to 5.0% by mass of W, 0.2 to 1.0% by mass of Nb, 0.05 to 0.2% by mass of N, and the balance of Fe and inevitable impurities. The heat-resistant cast steel has a two-phase structure of 20 to 95% of an austenite phase and the remainder of a ferrite phase.

However, since the austenitic heat-resistant cast steel described in JP 07-228950 A contains austenite crystal grains in a large part of the structure, while tensile strength at high temperatures is high, since austenite crystal grains are excessively contained, the thermal expansion coefficient is large and the thermal fatigue characteristics are insufficient.

On the other hand, since the heat-resistant cast steel described in JP 06-256908 A is a two-phase heat-resistant cast steel of an austenite phase and a ferrite phase, the thermal expansion due to austenite crystal grains such as described above can be reduced. However, the ferrite phase itself is present in the structure as crystal grains. Therefore, due to ferrite crystal grains softer than the austenite crystal grains, the tensile strength at high temperatures is not high. Thus, while the heat-resistant cast steel described in. JP 06-256908 A suppresses the thermal expansion, the tensile strength at high temperatures is smaller than that of a conventional austenitic heat-resistant cast steel and, as a result, the thermal fatigue characteristics were insufficient.

SUMMARY OF THE INVENTION

The present invention provides an austenitic heat-resistant cast steel that can improve thermal fatigue characteristics by suppressing the thermal expansion while maintaining tensile strength at high temperatures and a method of manufacturing the same.

The present inventors carried out many experiments and studies and came to a consideration that it is important to ensure the tensile strength of an austenitic heat-resistant cast steel at high temperatures due to austenite crystal grains and suppress thermal expansion of the austenitic heat-resistant cast steel by a ferrite phase. Specifically, it was newly found that with austenite crystal grains as a matrix structure, by not crystallizing the ferrite phase around the austenite crystal grains (without locating unevenly), but by intervening a fine ferrite phase between austenite crystal grains, the tensile strength of the austenitic heat-resistant cast steel can be maintained at high temperatures.

The present invention is based on the new finding of the present, inventors. A first aspect of the present invention relates to austenitic heat-resistant cast steel that includes 0.1 to 0.6% by mass of C, 1.0 to 3.0% by mass of Si, 0.5 to 1.5% by mass of Mn, 0.05% by mass or less of P, 0.05 to 0.3% by mass of 5, 14 to 20% by mass of Cr, 9 to 16% by mass of Ni, 0.1 to 0.2% by mass of N, and the balance of Fe and inevitable impurities. The matrix structure of the austenitic heat-resistant cast steel is configured of austenite crystal grains and a ferrite phase is dispersed and interposed between the austenite crystal grains so as to cover the austenite crystal grains.

A basic component of an austenitic heat-resistant cast steel of the present invention is an iron (Fe)-based austenitic heat-resistant cast steel, when a total thereof is set to 100% by mass (hereinafter, simply referred to as "%"), above-described components of carbon (C), silicon (Si), manganese (Mn), phosphorus (P), sulfur (S), chromium (Cr), nickel (Ni), and nitrogen (N) are contained in the ranges described above. Since the matrix structure is configured of austenite crystal grains and the ferrite phase is dispersed and interposed between the austenite crystal grains so as to cover the austenite crystal grains, while maintaining the tensile strength of the austenitic heat-resistant cast steel during high temperatures, by suppressing the thermal expansion, the thermal fatigue characteristics can be improved.

That is, the ferrite phase itself is not present in the structure as crystal grains but is dispersed such that the ferrite phase covers the austenite crystal grains. Therefore, due to the austenite crystal grains themselves, the tensile strength of the austenitic heat-resistant cast steel during high temperatures can be improved. Further, since the ferrite phase itself has a thermal expansion coefficient smaller than that of the austenite phase, the thermal expansion of the austenitic heat-resistant cast steel can be suppressed. As a result like this, the thermal fatigue characteristics of the austenitic heat-resistant cast steel can be drastically improved more than ever.

A second aspect of the present invention relates to an austenitic heat-resistant cast steel that includes 0.1 to 0.6% by mass of C, 1.0 to 3.0% by mass of Si, 0.5 to 1.5% by mass of Mn, 0.05% by mass or less of P, 0.05 to 0.3% by mass of S, 14 to 20% by mass of Cr, 9 to 16% by mass of Ni, 0.1 to 0.2% by mass of N, 1.0 to 3.0% by mass of Cu, and the balance of Fe and inevitable impurities. The matrix structure of the austenitic heat-resistant cast steel is configured of austenite crystal grains and a ferrite phase is dispersed and interposed between the austenite crystal grains so as to cover the austenite crystal grains. When the austenitic heat-resistant cast steel further includes copper (Cu) in the range described above, Cu is dissolved in the austenite crystal grains. Thus, the tensile strength of the austenitic heat-resistant cast steel can further be improved. As a result like this, the thermal fatigue characteristics of the austenitic heat-resistant cast steel can further be improved.

Now, when a content of Cu is less than 1% by mass, it is not so much expected to improve the tensile strength of the austenitic heat-resistant cast steel due to incorporation of Cu. On the other hand, when the content of Cu exceeds 3% by mass, not only the tensile strength of the austenitic heat-resistant cast steel cannot be expected to be improved more than that but also the thermal expansion of the austenitic heat-resistant cast steel drastically increases. As a result like this, compared to the austenitic heat-resistant cast steel that does not contain Cu, the thermal fatigue characteristics of the austenitic heat-resistant cast steel may be easily degraded.

An area ratio of the ferrite phase may be in the range of 1 to 10% with respect to a total structure of the austenitic heat-resistant cast steel. As obvious also from experiments of the present inventors described below, when the ferrite phase is contained in such an area ratio, the thermal fatigue characteristics of the austenitic-heat-resistant cast steel can more surely be improved more than ever.

That is, when the area ratio of the ferrite phase is less than 1% with respect to a total structure of the austenitic heat-resistant cast steel, the thermal expansion of the austenitic heat-resistant cast steel becomes larger. As a result like this, the thermal fatigue characteristics of the austenitic heat-resistant cast steel may be degraded.

On the other hand, when the area ratio of the ferrite phase exceeds 10% with respect to a total structure of the austenitic heat-resistant cast steel, the ferrite phase tends to be present as crystal grains in the structure. As a result like this, the tensile strength of the austenitic heat-resistant cast steel decreases during high temperatures and the thermal fatigue characteristics of the austenitic heat-resistant cast steel may be degraded.

A third aspect of the present invention relates to a method of manufacturing an austenitic heat-resistant cast steel. The method includes a step of casting a cast steel from a molten metal including 0.1 to 0.6% by mass of C, 1.0 to 3.0% by mass of Si, 0.5 to 1.5% by mass of Mn, 0.05% by mass or less of P, 0.05 to 0.3% by mass of S, 14 to 20% by mass of Cr, 9 to 16% by mass of Ni, 0.1 to 0.2% by mass of N, and the balance of Fe and inevitable impurities, and a step of heat treating the cast steel under heating condition of heating temperature of 700° C. to 800° C. and heating time period of 20 to 300 hrs.

According to the present invention, in the step of casting, when, with iron (Fe) that is a basic component of an austenitic heat-resistant cast steel as a basis, a total is set to 100% by mass (hereinafter, simply referred to as "%"), components of carbon (C), silicon (Si), manganese (Mn), phosphorus (P), sulfur (S), chromium (Cr), nickel (Ni), and nitrogen (N) described above are added in the ranges described above, the mixture is molten and a molten metal is prepared. When the molten metal is cast into a specified mold or the like and is cooled, a cast steel can be cast from the molten metal.

Next, in the step of heat treating, heat treatment is applied to the cast steel under heat treatment condition described above. Thus, a structure in which a matrix structure is configured of austenite crystal grains and a ferrite phase is dispersed and interposed between austenite crystal grains so as to cover the austenite crystal grains can be obtained. Further, an area ratio of the ferrite phase is in the range of 1 to 10% with respect to a total structure of the austenitic heat-resistant cast steel.

As a result like this, a structure of the austenitic heat-resistant cast steel can be obtained. Therefore, while maintaining the tensile strength of the austenitic heat-resistant cast steel during high temperatures, by suppressing the thermal expansion, the thermal fatigue characteristics can be improved.

A fourth aspect of the present invention relates to a method of manufacturing an austenitic heat-resistant cast steel. The method includes a step of casting a cast steel from a molten metal that consists of 0.1 to 0.6% by mass of C, 1.0 to 3.0% by mass of Si, 0.5 to 1.5% by mass of Mn, 0.05% by mass or less of P, 0.05 to 0.3% by mass of S, 14 to 20% by mass of Cr, 9 to 16% by mass of Ni, 0.1 to 0.2% by mass of N, 1.0 to 3.0% by mass of Cu, and the balance of Fe and inevitable impurities, and a step of heat treating the cast steel under heating condition of heating temperature of 700° C. to 800° C. and heating time period of 20 to 300 hrs. When copper (Cu) in the range described above is further added in the molten metal, Cu is dissolved in the austenite crystal grains. Thus, the tensile strength of the austenitic heat-resistant cast steel can be further increased. As a result like this, the thermal fatigue characteristics of the austenitic heat-resistant cast steel can be further improved.

Here, when an addition amount of Cu is less than 1% by mass, it is not so much expected to improve the tensile strength of the austenitic heat-resistant cast steel due to incorporation of Cu. On the other hand, when the addition amount of Cu exceeds 3% by mass, not only the tensile strength of the austenitic heat-resistant cast steel cannot be expected to be further improved but also the thermal expansion of the austenitic heat-resistant cast steel drastically increases. As a result like this, compared to the austenitic heat-resistant cast steel that does not contain Cu, the thermal fatigue characteristics of the austenitic heat-resistant cast steel may be easily degraded.

According to the present invention, while maintaining the tensile strength during high temperatures, by suppressing the thermal expansion, the thermal fatigue characteristics can be improved.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1A:
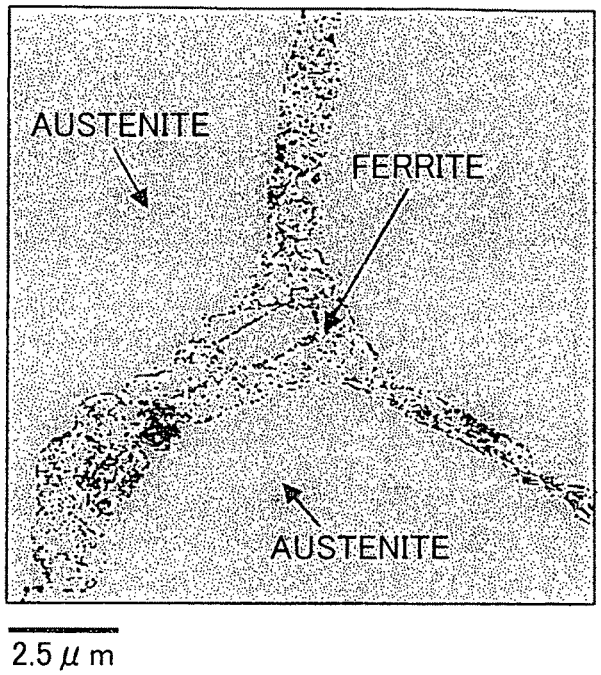
FIG. 1A is a structural photograph of an austenitic heat-resistant cast steel according to Example 4.

A method of manufacturing an austenitic heat-resistant cast steel of the present embodiment includes a step of casting cast steel from a molten metal including 0.1 to 0.6% by mass of C, 1.0 to 3.0% by mass of Si, 0.5 to 1.5% by mass of Mn, 0.05% by mass or less of P, 0.05 to 0.3% by mass of S, 14 to 20% by mass of Cr, 9 to 16% by mass of Ni, 0.1 to 0.2% by mass of N, and the balance of Fe and inevitable impurities, and a step of heat treating the cast steel under heating condition of heating temperature of 700° C. to 800° C. and heating time period of 20 to 300 hrs.

Thus, a structure in which with the components in the ranges described above as a basic component, a matrix structure is configured of austenite crystal grains, and a ferrite phase is dispersed and interposed between the austenite crystal grains so as to cover the austenite crystal grains (the entire austenite crystal grain) can be obtained. Further, an area ratio of the ferrite phase is in the range of 1 to 10% with respect to a whole structure of the austenitic heat-resistant cast steel.

In the thus-obtained austenitic heat-resistant cast steel, a ferrite phase itself is not unevenly distributed as crystal grains in the structure but is dispersed such that the ferrite phase cover the austenite crystal grains. As a result, due to the austenite crystal grains themselves, the tensile strength of the austenitic heat-resistant cast steel during high temperatures can be increased. In addition, since the ferrite phase itself has thermal expansion smaller than that of the austenite phase, the thermal expansion of the austenitic heat-resistant cast steel can be suppressed. As a result like this, the thermal fatigue characteristics of the austenitic heat-resistant cast steel can be improved more than ever.

Here, in the case where the area ratio of the ferrite phase is less than 1% with respect to a whole structure of the austenitic heat-resistant cast steel, due to an increase in a ratio of austenite crystal grains, the tensile strength of the austenitic heat-resistant cast steel can be ensured. However, the thermal expansion of the austenitic heat-resistant cast steel becomes larger. As a result like this, the thermal fatigue characteristics of the austenitic heat-resistant cast steel may be decreased.

On the other hand, in the case where the area ratio of the ferrite phase exceeds 10% with respect to a whole structure of the austenitic heat-resistant cast steel, due to an increase in the ferrite phase, the thermal expansion of the austenitic heat-resistant cast steel can be suppressed. However, the ferrite phase is likely to be unevenly distributed in the structure as crystal grains. Thus, the tensile strength of the austenitic heat-resistant cast steel is decreased during high temperatures. As a result like this, the thermal fatigue characteristics of the austenitic heat-resistant cast steel may be degraded.

In the austenitic heat-resistant cast steel of the present embodiment, the reasons why ranges of the respective components are limited as described above are as follows. With reference to examples shown below, values thereof are specifically described.

C: C in the range described above works as an austenite-stabilizing element and is effective for improving high temperature strength and castability. However, when the content thereof is less than 0.1% by mass, the castability is less improved. On the other hand, when the content exceeds 0.6% by mass, due to deposition of CrC, the structure hardness increases and the toughness is degraded. As a result, the machinability of the austenitic heat-resistant cast steel may be degraded.

Si: Si in the range described above is effective for improving oxidation-resistant performance and castability. However, when the content thereof is less than 1.0% by mass, the castability may be impaired. On the other hand, when the content exceeds 3.0% by mass, the machinability of the austenitic heat-resistant cast steel is degraded.

Mn: Mn in the range describe above promotes deoxygenation and stabilizes an austenite phase. However, when the content is less than 0.5% by mass, a casting defect is caused due to no deoxygenation effect. On the other hand, when the content exceeds 1.5% by mass, an austenite phase is deformation-induced and the machinability of the austenitic heat-resistant cast steel is degraded.

P: P in the range described above can avoid casting cracks and so on. When the content thereof exceeds 0.05% by mass, since the thermal degradation is likely to occur due to repetition of heating and cooling, also the toughness is degraded, the casting cracks are caused.

S: S in the range described above can ensure the machinability. However, the content thereof is less than 0.05% by mass, the machinability is degraded. When the content exceeds 0.3% by mass, S dissolves in the mother phase and the thermal fatigue life is degraded.

Cr: Cr in the range described above improves oxidation-resistance and is effective for improving the high temperature strength. When the content thereof is less than 14% by mass, an effect of the oxidation resistance is degraded. On the other hand, when the content exceeds 20% by mass, the structure hardness increases due to deposition of CrC. As a result, the machinability of the austenitic heat-resistant cast steel may be degraded.

Ni: Ni in the range described above can evenly disperse a ferrite phase so as to cover austenite crystal grains. When the content thereof is less than 9% by mass, as an area ratio of the ferrite phase exceeds 10%, crystal grains of the ferrite phase are generated. As a result thereof, the tensile strength of the austenitic heat-resistant cast steel decreases during high temperatures, and the thermal fatigue characteristics are impaired thereby. On the other hand, when the content exceeds 16% by mass, the area ratio of the ferrite phase is less than 1%, and due to the austenite crystal grains, the thermal expansion of the austenitic heat-resistant cast steel becomes larger. As a result thereof, the thermal fatigue characteristics of the austenitic heat-resistant cast steel are degraded.

N: N in the range described above is effective for improving the high temperature strength, stabilizing an austenite phase, and miniaturizing a structure. However, when the content thereof is less than 0.1%, it is ineffective, and when the content exceeds 0.2%, the yield drastically decreases and a gaseous defect is caused.

According to the present embodiment, Cu may be further added to the molten metal in the range of 1.0 to 3.0% by mass to make the austenitic heat-resistant cast steel contain Cu in the range like this. By further containing copper (Cu) in the range described above, Cu dissolves in the austenite crystal grains. Thus, the tensile strength of the austenitic heat-resistant cast steel can be further improved. As a result like this, the thermal fatigue characteristics of the austenitic heat-resistant cast steel can be further improved.

Here, when the content of Cu is less than 1% by mass, it is not so much expected that the incorporation of Cu improves the tensile strength of the austenitic heat-resistant cast steel. On the other hand, when the content of Cu exceeds 3% by mass, since a ferrite phase is disturbed from generating, the thermal expansion of the austenitic heat-resistant cast steel drastically increases. As a result like this, the thermal fatigue characteristics of the austenitic heat-resistant cast steel may be degraded compared to the austenitic heat-resistant cast steel that does not contain Cu.

Hereinafter, with reference to Examples and Comparative Examples, the present invention will be described in more detail.

Example 1

A sample of 50 kg that is a starting material of an Fe-based austenitic heat-resistant cast steel and has a composition shown in Table 1A was prepared and molten in air using a high-frequency induction furnace. The resulted molten metal was tapped at 1600° C., poured in a sand mold (without preheating) of 25 mm×25 mm×300 mm at 1550° C. and solidified, thus, a cast steel product (crude material) was obtained. The cast steel product was heat treated at a specified temperature (specifically 700° C. and 800° C.) shown in Table 2A for a specified time period (specifically 20 hours) in an air atmosphere furnace and a test piece made of the austenitic heat-resistant cast steel according to Example 1 was prepared.

Examples 2 to 14

In the same manner as that of the Example 1, test pieces of the austenitic heat-resistant cast steels were prepared. Specifically, the test pieces were cast with samples having compositions shown in Table 1A and heat treated under heating condition shown in Table 2A.

Comparative Examples 1 to 5

In the same manner as that of Example 1, test pieces of austenitic heat-resistant cast steels were prepared. Specifically, the test pieces were cast with samples having compositions shown in Table 1B and heat treated under heating condition shown in Table 2B. Comparative Examples 1 to 5 were out of the range of the present invention in a point that the heating time periods were set at less than 20 hrs.

Comparative Examples 6 to 11

In the same manner as that of Example 1, test pieces of austenitic heat-resistant cast steels were prepared. Specifically, the test pieces were cast with samples having compositions shown in Table 1B and heat treated under heating conditions shown in Table 2B. Comparative Examples 6 to 11 were out of the range of the present invention in a point that the addition amounts of Ni were set to less than 9% by mass, and Comparative Examples 6 and 9 were out of the range of the present invention a point that further the heating time periods were set to less than 20 hours.

Comparative Examples 12 to 14

In the same manner as that of Example 1, test pieces of austenitic heat-resistant cast steels were prepared. Specifically, the test pieces were cast with samples having compositions shown in Table 1B and heat treated under heating conditions shown in Table 2B. Comparative Examples 12 to 14 were out of the range of the present invention in a point that addition amounts of Ni were set to more than 16% by mass and further Comparative Example 12 was out of the range of the present invention in a point that the heating time period was set to less than 20 hours.

Comparative Example 15

In the same manner as that of Example 1, a test piece of the austenitic heat-resistant cast steel was prepared. Specifically, the test piece was cast with a sample having a composition shown in Table 1B and heat treated under heating conditions shown in Table 2B. In particular, Comparative Example 15 was out of the range of the present invention in a point that an addition amount of Cu was set to more than 3% by mass.

Comparative Examples 16 to 18

In the same manner as that of Example 1, test pieces of the austenitic heat-resistant cast steels were prepared. Specifically, the test pieces were cast with samples having compositions shown in Table 1B and heat treated under heating conditions shown in Table 2B. In particular, Comparative Examples 16 to 18 were out of the range of the present invention a point that the heating temperatures were set to more than 800° C. (specifically 810° C.).

Comparative Examples 19 to 21

In the same manner as that of Example 1, test pieces of the austenitic heat-resistant cast steels were prepared. Specifically, the test pieces were cast with samples having compositions shown in Table 1B and heat treated under heating conditions shown in Table 2B. In particular, Comparative Examples 19 to 21 were out of the range of the present invention in a point that the heating temperatures were set to less than 700° C. (specifically 690° C.).

TABLE 1A

| (% by mass) | C | Si | Mn | P | S | Cr | Ni | N | Cu | Fe |
|---|---|---|---|---|---|---|---|---|---|---|
| Example 1 | 0.1 | 1.0 | 0.5 | 0.020 | 0.05 | 14 | 9 | 0.10 | 0 | Balance |
| Example 2 | 0.1 | 1.0 | 0.5 | 0.020 | 0.05 | 14 | 9 | 0.10 | 0 | Balance |
| Example 3 | 0.1 | 1.0 | 0.5 | 0.020 | 0.05 | 14 | 9 | 0.10 | 0 | Balance |
| Example 4 | 0.3 | 2.0 | 1.0 | 0.019 | 0.20 | 17 | 12 | 0.15 | 0 | Balance |
| Example 5 | 0.3 | 2.0 | 1.0 | 0.019 | 0.10 | 17 | 12 | 0.15 | 0 | Balance |
| Example 6 | 0.3 | 2.0 | 1.0 | 0.019 | 0.10 | 17 | 12 | 0.15 | 0 | Balance |
| Example 7 | 0.6 | 2.0 | 1.5 | 0.019 | 0.30 | 20 | 14 | 0.20 | 0 | Balance |
| Example 8 | 0.6 | 2.0 | 1.5 | 0.019 | 0.30 | 20 | 14 | 0.20 | 0 | Balance |
| Example 9 | 0.6 | 2.0 | 1.5 | 0.019 | 0.30 | 20 | 14 | 0.20 | 0 | Balance |
| Example 10 | 0.3 | 3.0 | 1.0 | 0.022 | 0.10 | 18 | 16 | 0.15 | 0 | Balance |
| Example 11 | 0.3 | 2.5 | 1.0 | 0.022 | 0.10 | 18 | 16 | 0.15 | 0 | Balance |
| Example 12 | 0.3 | 2.5 | 1.0 | 0.022 | 0.10 | 18 | 16 | 0.15 | 0 | Balance |
| Example 13 | 0.3 | 2.5 | 1.0 | 0.022 | 0.10 | 18 | 16 | 0.15 | 1 | Balance |
| Example 14 | 0.3 | 2.5 | 1.0 | 0.022 | 0.10 | 18 | 16 | 0.15 | 3 | Balance |

TABLE 1B

| (% by mass) | C | Si | Mn | P | S | Cr | Ni | N | Cu | Fe |
|---|---|---|---|---|---|---|---|---|---|---|
| Comparative Example 1 | 0.2 | 1.0 | 0.5 | 0.020 | 0.10 | 17 | 9 | 0.10 | 0 | Balance |
| Comparative Example 2 | 0.2 | 3.0 | 0.5 | 0.020 | 0.10 | 17 | 9 | 0.10 | 0 | Balance |
| Comparative Example 3 | 0.2 | 3.0 | 1.0 | 0.019 | 0.10 | 19 | 12 | 0.15 | 0 | Balance |
| Comparative Example 4 | 0.2 | 3.0 | 1.5 | 0.019 | 0.30 | 20 | 14 | 0.20 | 0 | Balance |
| Comparative Example 5 | 0.2 | 3.0 | 1.0 | 0.022 | 0.30 | 18 | 16 | 0.15 | 0 | Balance |
| Comparative Example 6 | 0.6 | 2.0 | 1.0 | 0.021 | 0.05 | 18 | 5 | 0.15 | 0 | Balance |
| Comparative Example 7 | 0.6 | 2.0 | 1.0 | 0.021 | 0.05 | 18 | 5 | 0.15 | 0 | Balance |
| Comparative Example 8 | 0.6 | 2.0 | 1.0 | 0.021 | 0.05 | 18 | 5 | 0.15 | 0 | Balance |
| Comparative Example 9 | 0.3 | 2.0 | 1.0 | 0.019 | 0.10 | 20 | 8 | 0.15 | 0 | Balance |
| Comparative Example 10 | 0.3 | 2.0 | 1.0 | 0.019 | 0.10 | 20 | 8 | 0.15 | 0 | Balance |
| Comparative Example 11 | 0.3 | 2.0 | 1.0 | 0.019 | 0.10 | 18 | 8 | 0.15 | 0 | Balance |
| Comparative Example 12 | 0.3 | 2.0 | 1.0 | 0.019 | 0.10 | 18 | 17 | 0.15 | 0 | Balance |
| Comparative Example 13 | 0.3 | 2.0 | 1.0 | 0.019 | 0.10 | 18 | 17 | 0.15 | 0 | Balance |
| Comparative Example 14 | 0.3 | 2.0 | 1.0 | 0.019 | 0.10 | 18 | 17 | 0.15 | 0 | Balance |
| Comparative Example 15 | 0.3 | 2.5 | 1.0 | 0.022 | 0.10 | 18 | 16 | 0.15 | 4 | Balance |
| Comparative Example 16 | 0.1 | 1.0 | 0.5 | 0.020 | 0.05 | 14 | 9 | 0.10 | 0 | Balance |
| Comparative Example 17 | 0.1 | 1.0 | 0.5 | 0.020 | 0.05 | 14 | 9 | 0.10 | 0 | Balance |
| Comparative Example 18 | 0.1 | 1.0 | 0.5 | 0.020 | 0.05 | 14 | 9 | 0.10 | 0 | Balance |
| Comparative Example 19 | 0.3 | 3.0 | 1.0 | 0.022 | 0.10 | 18 | 16 | 0.15 | 0 | Balance |
| Comparative Example 20 | 0.3 | 2.5 | 1.0 | 0.022 | 0.10 | 18 | 16 | 0.15 | 0 | Balance |
| Comparative Example 21 | 0.3 | 2.5 | 1.0 | 0.022 | 0.10 | 18 | 16 | 0.15 | 0 | Balance |

TABLE 2A

| | Heating time period (hrs) | Heating temperature (° C.) | Ferrite area ratio (%) | Thermal expansion coefficient (1/K) | Tensile strength (MPa) | Fatigue life (times) |
|---|---|---|---|---|---|---|
| Example 1 | 20 | 700, 800 | 10 | 16.0 | 110 | 240 |
| Example 2 | 50 | 700, 800 | 10 | 16.0 | 111 | 242 |
| Example 3 | 300 | 700, 800 | 10 | 16.0 | 111 | 242 |
| Example 4 | 20 | 700, 800 | 7 | 16.0 | 115 | 240 |
| Example 5 | 50 | 700, 800 | 7 | 16.1 | 114 | 241 |
| Example 6 | 300 | 700, 800 | 7 | 16.1 | 114 | 240 |
| Example 7 | 20 | 700, 800 | 4 | 16.1 | 111 | 245 |
| Example 8 | 50 | 700, 800 | 4 | 16.2 | 112 | 248 |

TABLE 2A-continued

| | Heating time period (hrs) | Heating temperature (° C.) | Ferrite area ratio (%) | Thermal expansion coefficient (1/K) | Tensile strength (MPa) | Fatigue life (times) |
|---|---|---|---|---|---|---|
| Example 9 | 300 | 700, 800 | 4 | 16.2 | 112 | 247 |
| Example 10 | 20 | 700, 800 | 1 | 16.2 | 113 | 237 |
| Example 11 | 50 | 700, 800 | 1 | 16.2 | 115 | 238 |
| Example 12 | 300 | 700, 800 | 1 | 16.2 | 115 | 237 |
| Example 13 | 20 | 700, 800 | 1 | 16.0 | 140 | 290 |
| Example 14 | 20 | 700, 800 | 1 | 16.1 | 142 | 295 |

TABLE 2B

| | Heating time period (hrs) | Heating temperature (° C.) | Ferrite area ratio (%) | Thermal expansion coefficient (1/K) | Tensile strength (MPa) | Fatigue life (times) |
|---|---|---|---|---|---|---|
| Comparative Example 1 | 10 | 700, 800 | 0 | 19.5 | 110 | 190 |
| Comparative Example 2 | 19 | 700, 800 | 0 | 19.5 | 111 | 186 |
| Comparative Example 3 | 19 | 700, 800 | 0 | 19.8 | 115 | 191 |
| Comparative Example 4 | 19 | 700, 800 | 0 | 20.0 | 111 | 192 |
| Comparative Example 5 | 19 | 700, 800 | 0 | 20.5 | 113 | 190 |
| Comparative Example 6 | 10 | 700, 800 | 20 | 13.0 | 30 | 80 |
| Comparative Example 7 | 20 | 700, 800 | 20 | 13.0 | 30 | 80 |
| Comparative Example 8 | 300 | 700, 800 | 20 | 13.0 | 30 | 80 |
| Comparative Example 9 | 10 | 700, 800 | 11 | 13.1 | 50 | 100 |
| Comparative Example 10 | 20 | 700, 800 | 11 | 13.1 | 50 | 100 |
| Comparative Example 11 | 300 | 700, 800 | 11 | 13.1 | 50 | 100 |
| Comparative Example 12 | 10 | 700, 800 | 0 | 19.5 | 115 | 195 |
| Comparative Example 13 | 20 | 700, 800 | 0 | 19.6 | 116 | 196 |
| Comparative Example 14 | 300 | 700, 800 | 0 | 19.8 | 115 | 196 |
| Comparative Example 15 | 20 | 700, 800 | 0 | 20.0 | 140 | 194 |
| Comparative Example 16 | 20 | 810 | 11 | 13.0 | 51 | 101 |

TABLE 2B-continued

| | Heating time period (hrs) | Heating temperature (° C.) | Ferrite area ratio (%) | Thermal expansion coefficient (1/K) | Tensile strength (MPa) | Fatigue life (times) |
|---|---|---|---|---|---|---|
| Comparative Example 17 | 50 | 810 | 11 | 13.1 | 50 | 101 |
| Comparative Example 18 | 300 | 810 | 11 | 13.1 | 52 | 100 |
| Comparative Example 19 | 20 | 690 | 0 | 19.8 | 116 | 195 |
| Comparative Example 20 | 50 | 690 | 0 | 19.7 | 116 | 195 |
| Comparative Example 21 | 300 | 690 | 0 | 19.8 | 115 | 196 |

<Structure Observation and Measurement of Ferrite Area Ratio>

A structure of each of test pieces of austenitic heat-resistant cast steels according to Examples 1 to 14 and Comparative Examples 1 to 21 was observed by an Electron Back Scatter Diffraction (EBDS) method and a ferrite area ratio thereof was measured. The ferrite area ratio was calculated by image processing. The ferrite area ratio is a ratio of an area which is occupied by ferrite with respect to an area of a whole structure (all viewing field) in a rectangular observing field of 30 μm×30 μm. Results thereof are shown in Tables 2A and 2B. For Examples 1 to 14 and Comparative Examples 1 to 15, since difference was hardly found between values at the heating temperatures of 700° C. and 800° C., average values thereof are shown in Tables 2A and 2B.

Figure 1B:
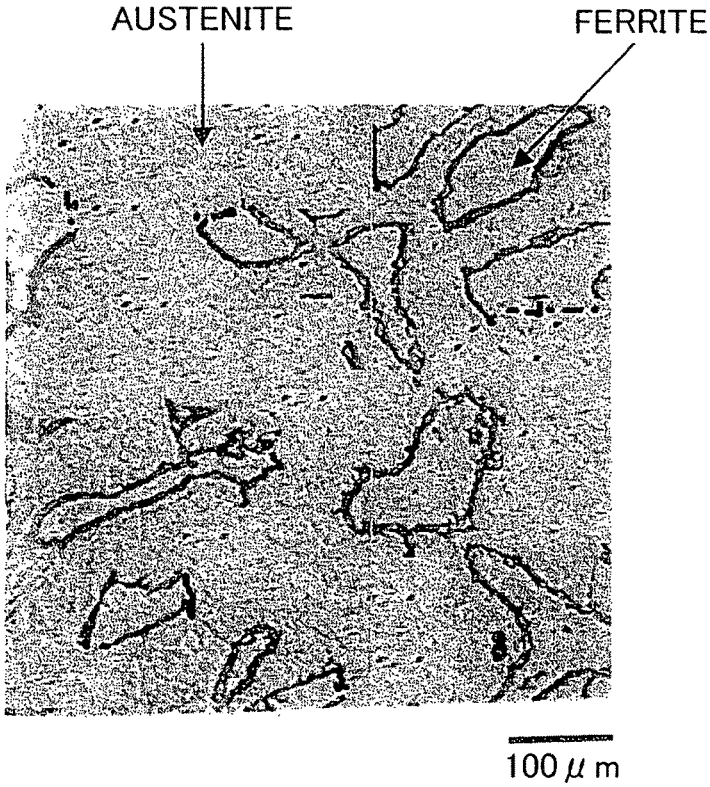
FIG. 1B is a structural photograph of an austenitic heat-resistant cast steel according to Comparative Example 6.
Figure 2:
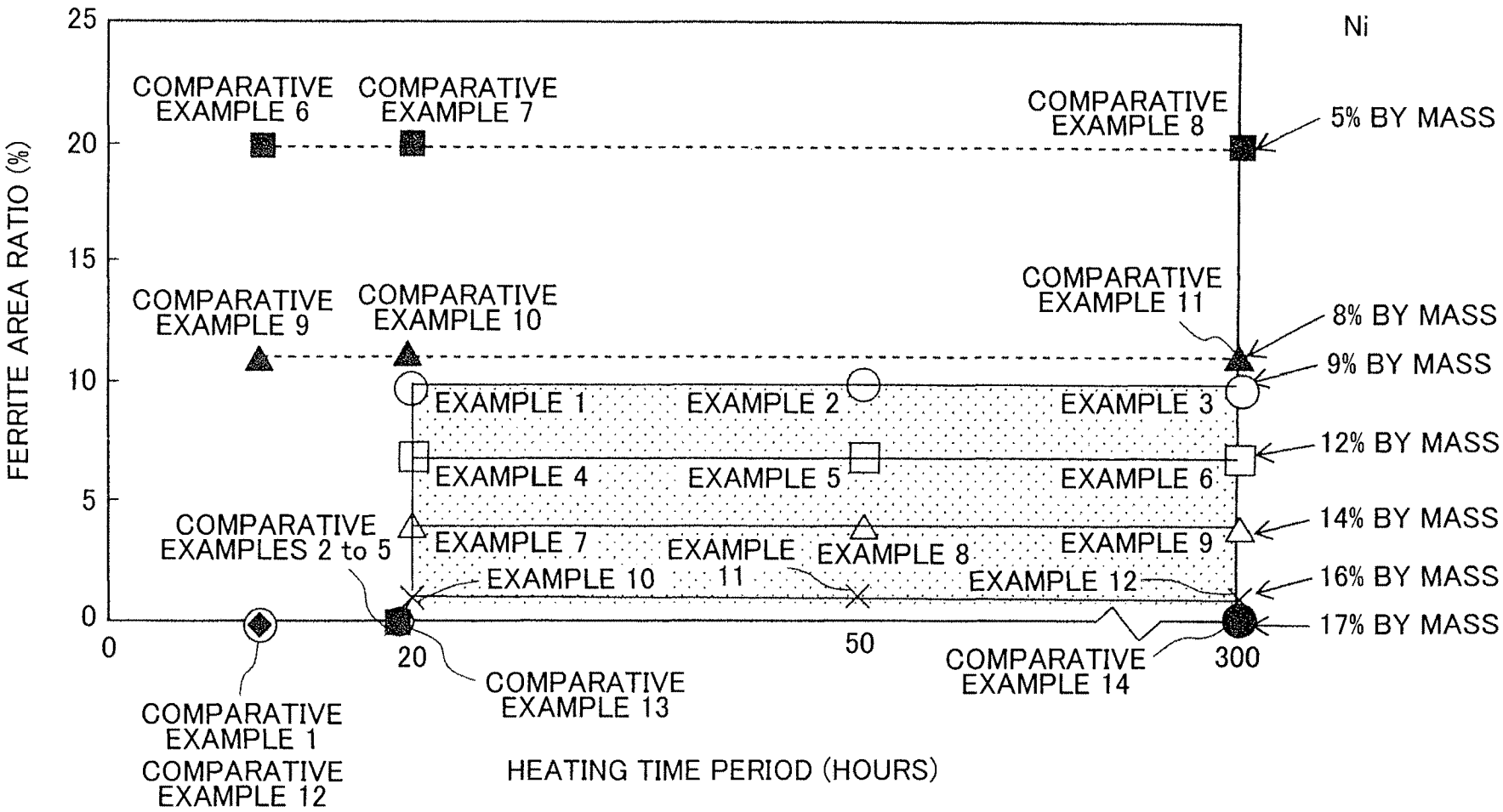
FIG. 2 is a chart that shows a relationship between ferrite area ratios of the austenitic heat-resistant cast steels according to Examples 1 to 12 and Comparative Examples 1 to 14 and heating time periods.

FIG. 1A is a structural photograph of an austenitic heat-resistant cast steel according to Example 4, and FIG. 1B is a structural photograph of an austenitic heat-resistant cast steel according to Comparative Example 6. FIG. 2 shows a relationship between ferrite area ratios of the austenitic heat-resistant cast steels of Examples 1 to 12 and Comparative Examples 1 to 14 and heating time periods thereof.

<Measurement of Thermal Expansion Coefficient>

A thermal expansion coefficient of each of test pieces of austenitic heat-resistant cast steels according to Examples 1 to 14 and Comparative Examples 1 to 21 was measured. Specifically, the thermal expansion coefficient at 900° C. was measured using a push rod type dilatometer. As a shape of the test piece, 6 mm diameter by 50 mm was used and a measurement was conducted by comparing with thermal expansion of quartz glass. Results thereof are shown in Tables 2A and 2B. For Examples 1 to 14 and Comparative Examples 1 to 15, since difference was hardly found between values at the heating temperatures of 700° C. and 800° C., average values thereof are shown in Tables 2A and 2B.

Figure 3:
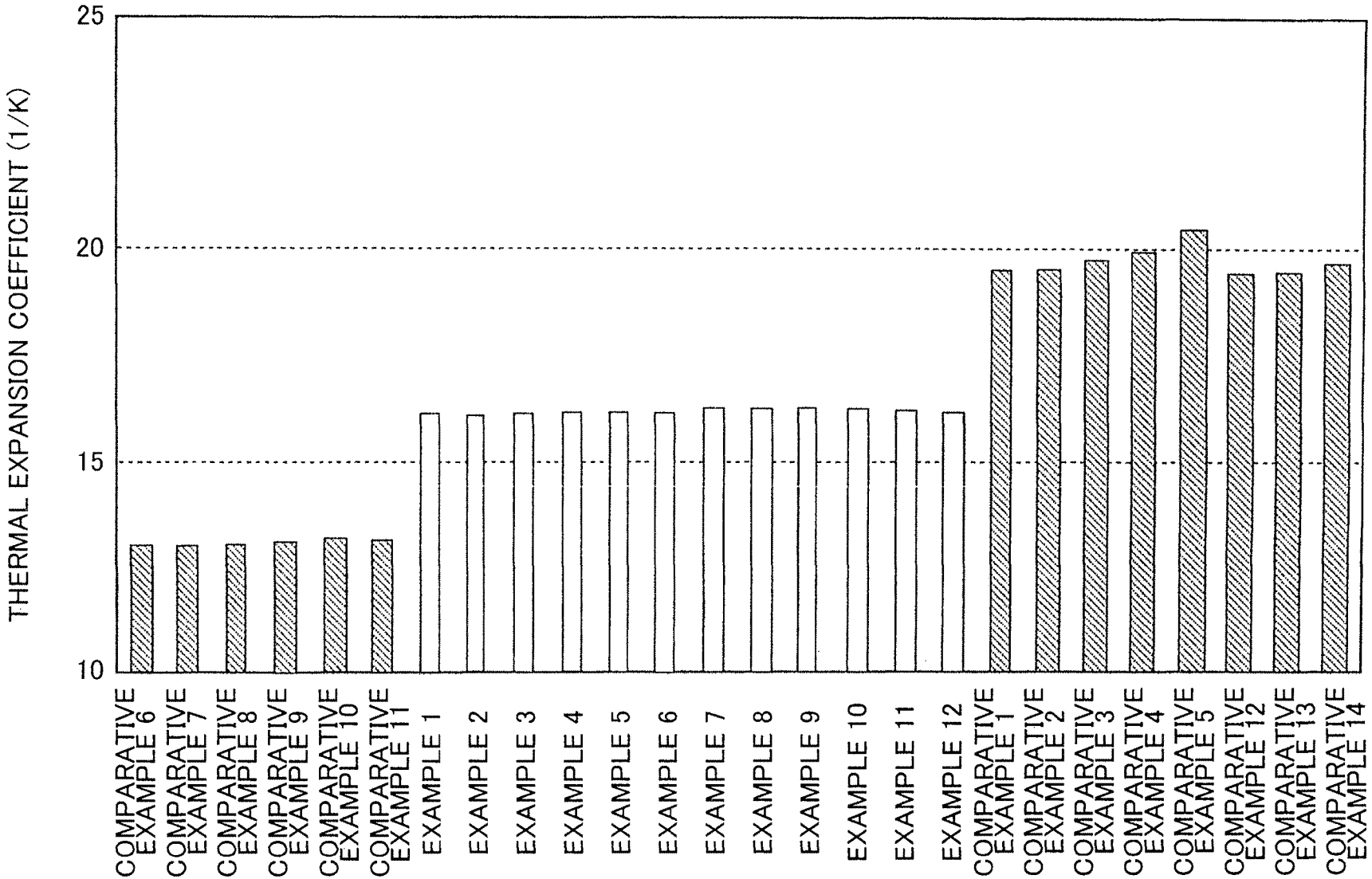
FIG. 3 is a chart that shows measurement results of thermal expansion coefficients of the austenitic heat-resistant cast steels according to Examples 1 to 12 and Comparative Examples 1 to 14.
Figure 6:
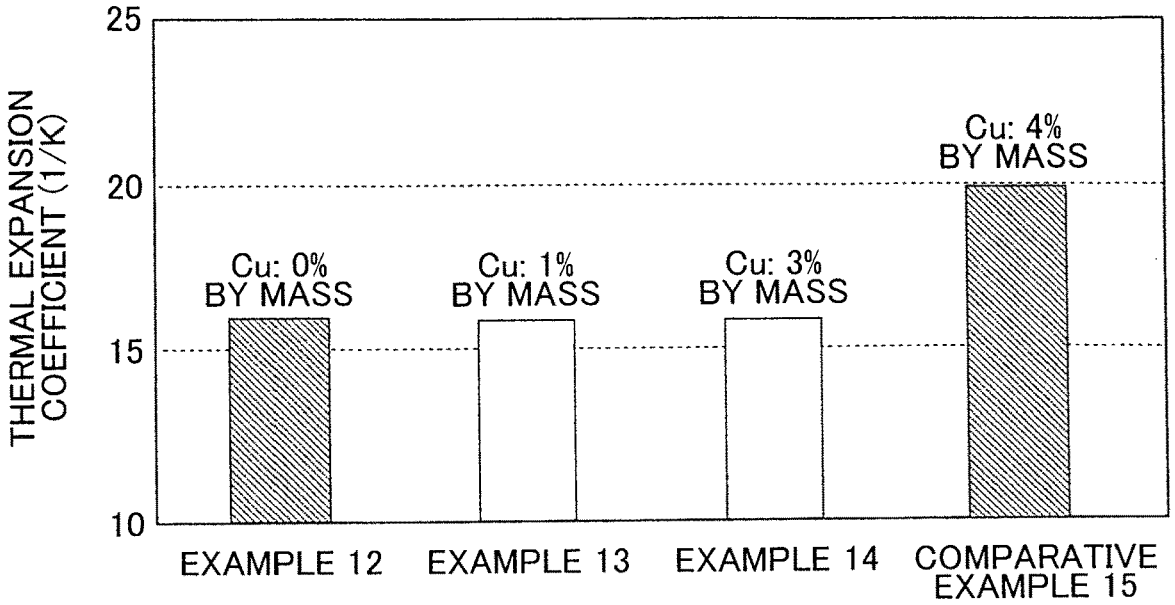
FIG. 6 is a chart that shows measurement results of thermal expansion coefficients of the austenitic heat-resistant cast steels according to Examples 12 to 14 and Comparative Example 15.

FIG. 3 shows measurement results of the thermal expansion coefficients of austenitic heat-resistant cast steels according to Examples 1 to 12 and Comparative Examples 1 to 14, and FIG. 6 shows measurement results of the thermal expansion coefficients of austenitic heat-resistant cast steels of Examples 12 to 14 and Comparative Example 15.

<Measurement of Tensile Strength>

The tensile strength measurement was conducted on test pieces of austenitic heat-resistant cast steels according to Examples 1 to 14 and Comparative Examples 1 to 21. Specifically, the test was conducted in accordance with JIS Z2241 and JIS G0567 and the tensile strength at a temperature of 900° C. was measured. Results thereof are shown in Tables 2A and 2B.

Figure 4:
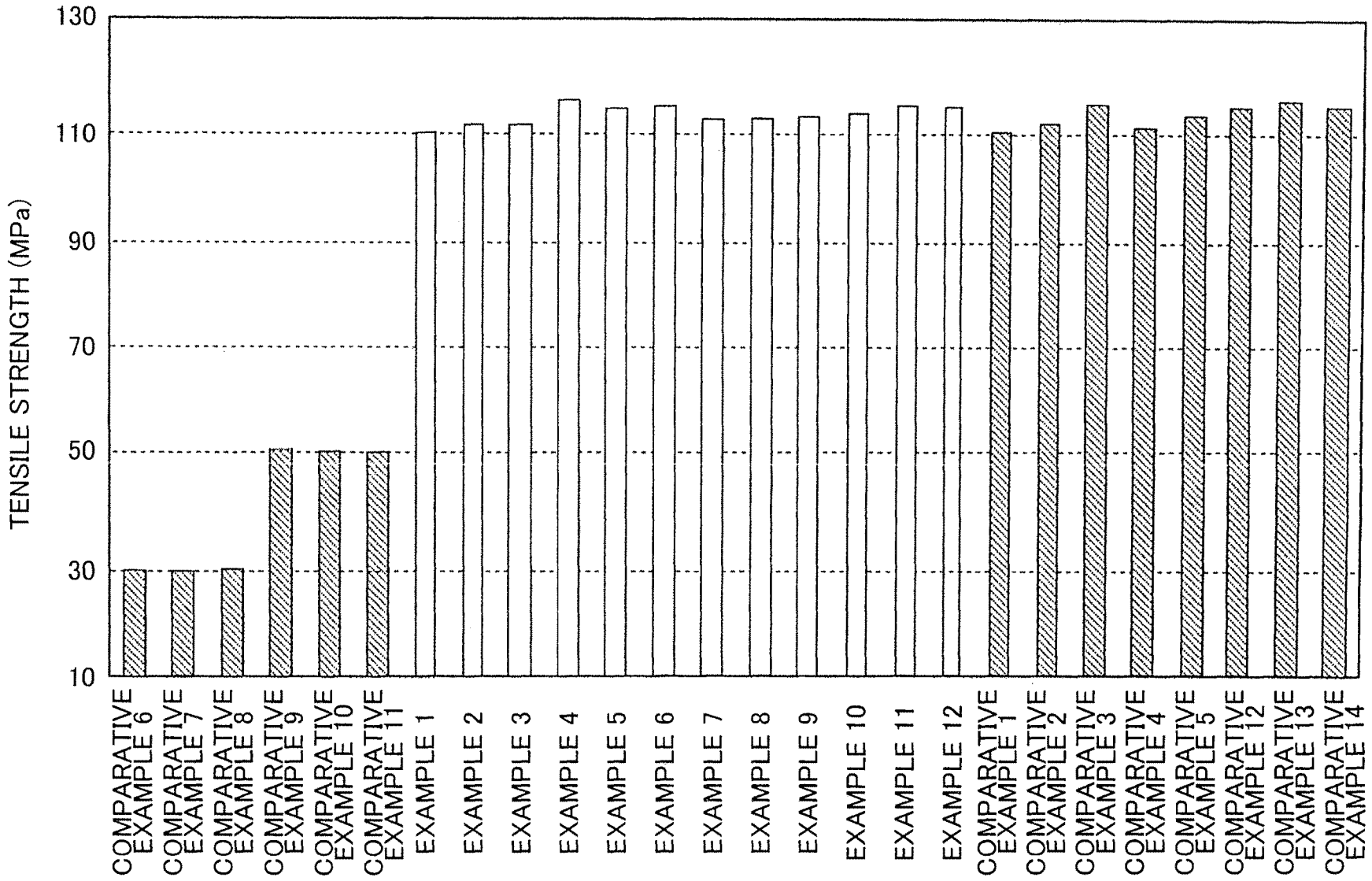
FIG. 4 is a chart that shows measurement results of tensile strengths of the austenitic heat-resistant cast steels according to Examples 1 to 12 and Comparative Examples 1 to 14.
Figure 7:
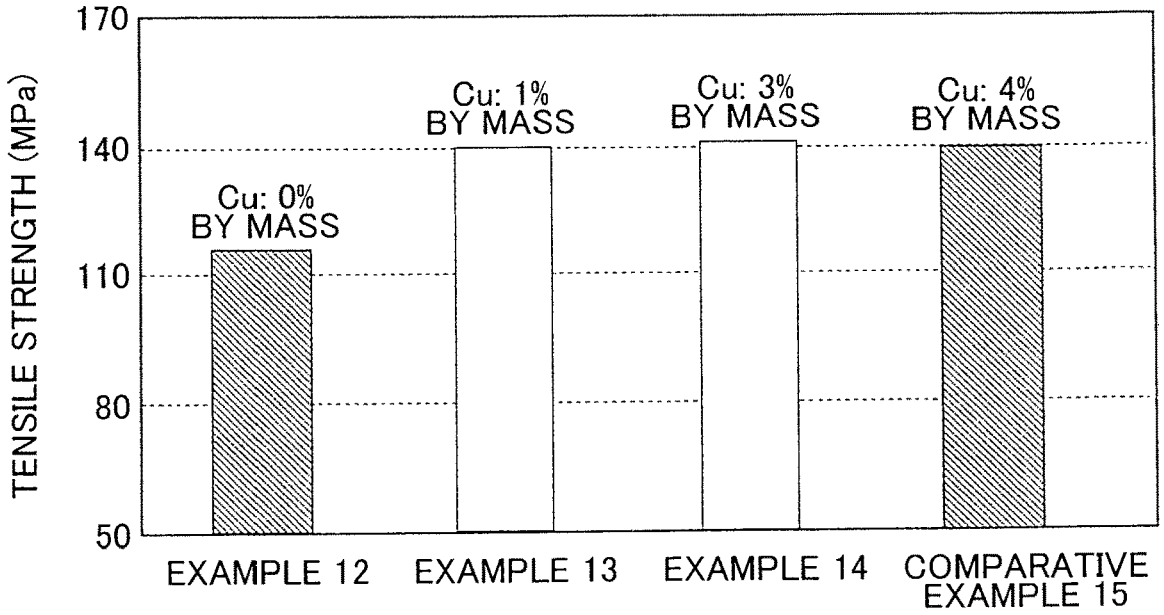
FIG. 7 is a chart that shows measurement results of tensile strength of the austenitic heat-resistant cast steels according to Examples 12 to 14 and Comparative Example 15.

FIG. 4 is a diagram that shows measurement results of the tensile strengths of austenitic heat-resistant cast steels according to Examples 1 to 12 and Comparative Examples, 1 to 14, and FIG. 7 is a diagram that shows measurement results of the tensile strengths of austenitic heat-resistant cast steels according to Examples 12 to 14 and Comparative Example 15. For Examples 1 to 14 and Comparative Examples 1 to 15, a difference between values at heating temperature of 700° C. and 800° C. was hardly found, therefore, average values thereof are shown in Tables 2A and 2B.

<Measurement of Thermal Fatigue Life>

A thermal fatigue test was conducted on each of test pieces of austenitic heat-resistant cast steels according to Examples 1 to 14 and Comparative Examples 1 to 21. In this thermal fatigue test, which was conducted with an electro-hydraulic servo-type thermal fatigue tester, using a test piece (gauge distance, 15 mm; gauge diameter, 8 mm), thermal expansion and elongation of the test piece was measured by heating from a temperature midway between the upper limit and lower limit temperatures under a 100% constraint ratio (a mechanically completely constrained state), and triangular wave heating-cooling cycles (lower limit temperature: 200° C., upper limit temperature: 900° C.) lasting 9 minutes per cycle were repeated. The thermal fatigue characteristics were evaluated based on the number of cycles until the test piece, was completely broken. Results thereof are shown in Tables 2A and 2B. For Examples 1 to 14 and Comparative Examples 1 to 15, a difference between values at heating temperature of 700° C. and 800° C. was hardly found, and thus, average values thereof are shown in Tables 2A and 2B.

Figure 5:
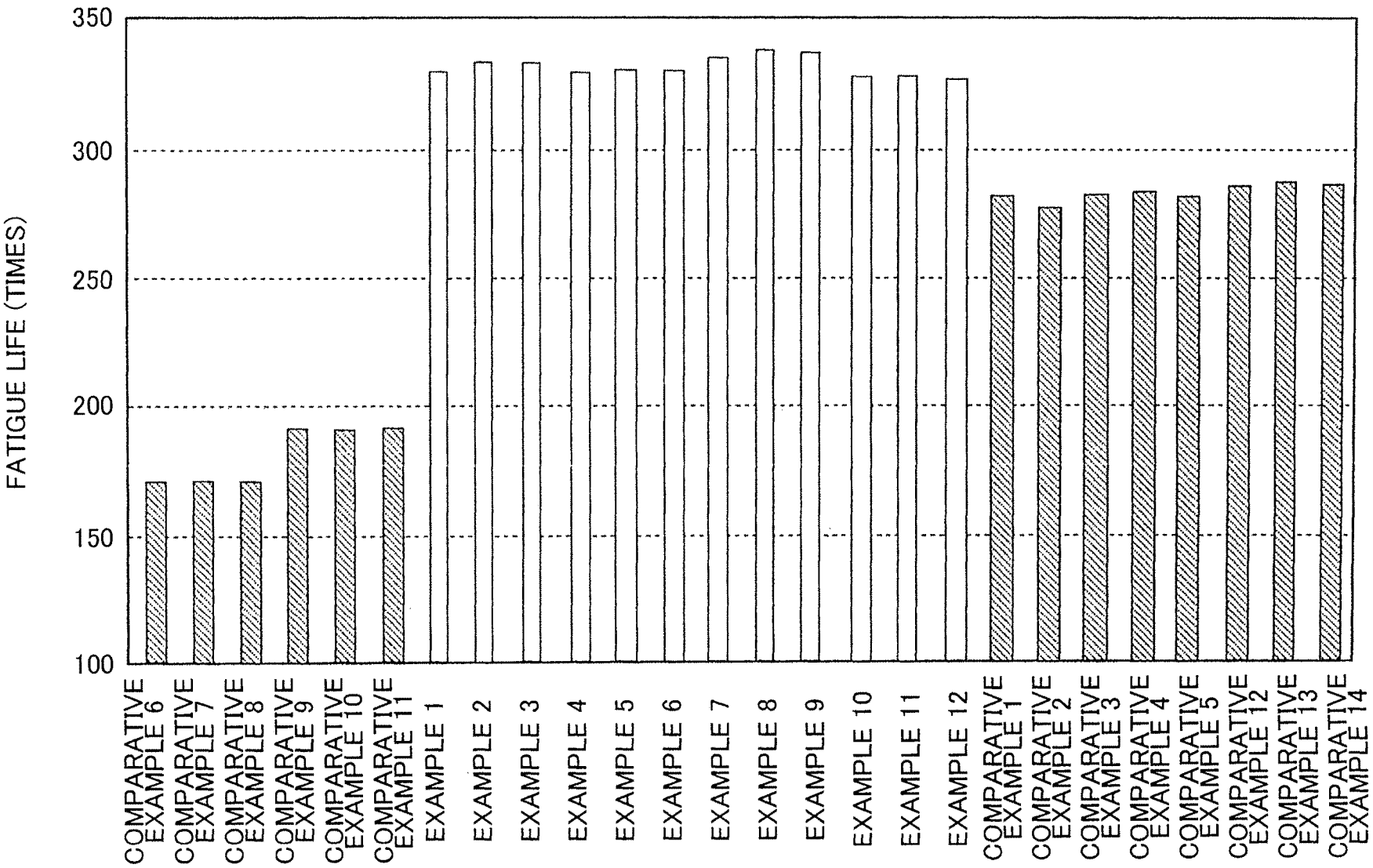
FIG. 5 is a chart that shows measurement results of thermal fatigue lives of the austenitic heat-resistant cast steels according to Examples 1 to 12 and Comparative Examples 1 to 14.
Figure 8:
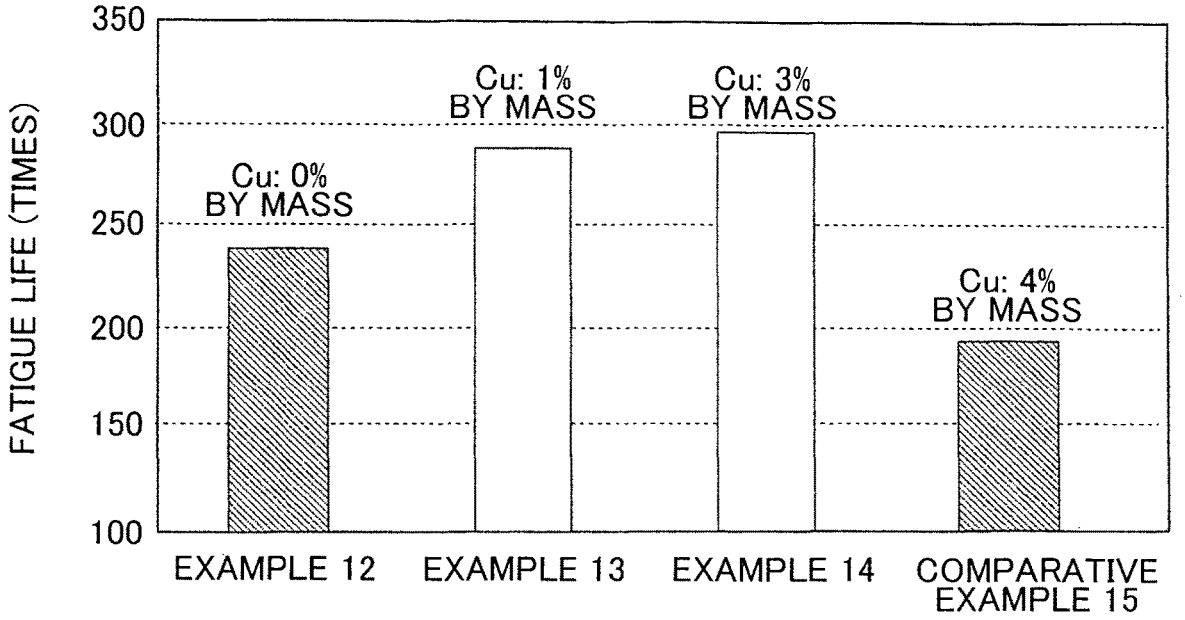
FIG. 8 is a chart that shows measurement results of thermal fatigue lives of the austenitic heat-resistant cast steels according to Examples 12 to 14 and Comparative Example 15.

FIG. 5 is a diagram that shows measurement results of the thermal fatigue lives of austenitic heat-resistant cast steels according to Examples 1 to 12 and Comparative Examples 1 to 14, and FIG. 8 is a diagram that shows measurement, results of the thermal fatigue lives of austenitic heat-resistant cast steels according to Examples 12 to 14 and Comparative Example 15.

[Result 1: Of Ferrite Phase and Ferrite Area Ratio]

As shown in Tables 2A and 2B and FIG. 2, austenitic heat-resistant cast steels according to Examples 1 to 12 had the area ratios of the ferrite phase in the range of 1 to 10% with respect to a whole structure of the austenitic heat-resistant cast steel. This is considered because the content of Ni was set to 9 to 16% by mass, and heating conditions of heating temperature of 700° C. to 800° C. and heating time period of 20 to 300 hours were used to heat treat.

In a structure obtained like this, as shown in FIG. 1A, a matrix structure was configured of austenite crystal grains and a ferrite phase was dispersed and interposed between austenite crystal grains so as to cover the austenite crystal grains.

On the other hand, in austenitic heat-resistant cast steels according to Comparative Examples 1 to 5 (heating time period: less than 20 hours) and Comparative Examples 12 to 14 (addition amount of Ni: more than 16% by mass), a ferrite phase was not generated. Further, in austenitic heat-resistant cast steels according to Comparative Examples 6 to 11 (addition amount of Ni: less than 9% by mass), area ratios of the ferrite phase exceeded 10%. In addition, as crystal grains, both of austenite crystal grains and ferrite crystal grains were generated.

Further, as shown in Tables 2A and 2B, austenitic heat-resistant cast steels according to Comparative Examples 16 to 18 (heating temperature: higher than 800° C.) had the area ratio of ferrite phase exceeding 10%. Austenitic heat-resistant cast steels according to Comparative Examples 19 to 21 (heating temperature: less than 700° C.) had the area ratio of ferrite phase of less than 1%.

[Result 2: Of Thermal Expansion Coefficient]

As shown in FIG. 3, the thermal expansion coefficients of austenitic heat-resistant cast steels according to Examples 1 to 12 were lower than those of Comparative Examples 1 to 5 and Comparative Examples 12 to 14 and higher than those of Comparative Examples 6 to 11. That is, the thermal expansion coefficients of austenitic heat-resistant cast steels according to Examples 1 to 12 had an intermediate value of those of Comparative Examples 1 to 5 and Comparative Examples 12 to 14 and those of Comparative Examples 6 to 11.

Further, the thermal expansion coefficients of austenitic heat-resistant cast steels according to Examples 1 to 14 and Comparative Examples 1 to 21 are shown in Tables 2A and 2B. From FIG. 3 and Tables 2A and 2B, it is found that the ferrite area ratios of austenitic heat-resistant cast steels according to Examples 1 to 14 are in the range of 1 to 10%, the ferrite area ratios of austenitic heat-resistant cast steels according to Comparative Examples 1 to 5, Comparative Examples 12 to 15, and Comparative Examples 19 to 21 are less than 1%, and the ferrite area ratios of austenitic heat-resistant cast steels according to Comparative Examples 6 to 11 and Comparative Examples 16 to 18 exceed 10%. This is considered because the thermal expansion coefficient of austenitic heat-resistant cast steel depends on the ferrite area ratio.

That is, it is considered that the higher the occupancy rate of the ferrite phase of austenitic heat-resistant cast steel is, the lower the thermal expansion coefficient of the austenitic heat-resistant cast steel is. As the thermal expansion coefficient of the austenitic heat-resistant cast steel becomes lower, the thermal expansion is suppressed and tends to be advantageous for the thermal fatigue characteristics.

[Result 3: Of Tensile Strength]

As shown in FIG. 4 and Tables 2A and 2B, the tensile strengths of austenitic heat-resistant cast steels according to Examples 1 to 12 were the same level as those of Comparative Examples 1 to 5, Comparative Examples 12 to 14, and Comparative Examples 19 to 21, and higher than those of Comparative Examples 6 to 11 and Comparative Examples 16 to 18. Further, the tensile strengths of austenitic heat-resistant cast steels according to Examples 1 to 14 and Comparative Examples 1 to 21 are shown in Tables 2A and 2B. A reason why the tensile strengths of austenitic heat-resistant cast steels according to Comparative Examples 6 to 11 and Comparative Examples 16 to 18 were lower than those of others is considered because ferrite crystal grains were generated in the austenitic heat-resistant cast steel.

On the other hand, it is considered because in the austenitic heat-resistant cast steels according to Examples 1 to 12, a ferrite phase is dispersed and interposed between austenite crystal grains so as to cover the austenite crystal grains (a ferrite phase is formed in the vicinity of grain boundaries of the austenite crystal grains), the tensile strengths at the same level as those of Comparative Examples 1 to 5, Comparative Examples 12 to 14, and Comparative Examples 19 to 0.21 could be ensured.

[Result 4: Of Thermal Fatigue Characteristics]

As shown in FIG. 5, fatigue lives of austenitic heat-resistant cast steels according to Examples 1 to 12 were longer than those of other Comparative Examples. Further, in Tables 2A and 2B, the fatigue lives of austenitic heat-resistant cast steels according to Examples 1 to 14 and Comparative Examples 1 to 21 are shown. From FIG. 5 and Tables 2A and 2B, it is considered that because in the case of austenitic heat-resistant cast steels according to Comparative Examples 1 to 5, Comparative Examples 12 to 15 and Comparative Examples 19 to 21, the tensile strengths thereof were of the same level as those of austenitic heat-resistant cast steels according to Examples 1 to 12 but the thermal expansion coefficients thereof were higher than those of Examples 1 to 12, the thermal fatigue lives thereof became shorter than those of Examples 1 to 12.

On the other hand, in the case of austenitic heat-resistant cast steels according- to Comparative Examples 6 to 11 and Comparative Examples 16 to 18, it is considered that because the tensile strengths thereof were drastically smaller than those of austenitic heat-resistant cast steels according to Examples 1 to 12, the thermal fatigue lives became shorter than those of Examples 1 to 12.

[Result 5: On Effect when Cu is Further Added]

As shown in FIG. 6, the thermal expansion coefficients of austenitic heat-resistant cast steels according to Examples 12 to 14 are lower than that of Comparative Example 15. It is considered that because as in Comparative Example 15, when the content of Cu exceeds 3% by mass, a ferrite phase is not generated and thermal expansion of austenite-based heat-resistant cast steel is largely increased.

As shown in FIG. 7, the tensile strengths of austenitic heat-resistant cast steels according to Examples 13 and 14 and Comparative Example 15 were, higher than that of Example 12. This is considered because Cu dissolved in austenite crystal grains of the austenitic heat-resistant cast steel.

As shown in FIG. 8, the fatigue lives of the austenitic heat-resistant cast steels according to Examples 13 and 14 were longer than those of Example 12 and Comparative Example 15. This is considered because, by addition of 1.0 to 3.0% by mass of Cu, the tensile strength of the austenitic heat-resistant cast steel was improved.

Examples 15 to 18

In the same manner as that of Example 1, test pieces of the austenitic heat-resistant cast steels were prepared. Specifically, test pieces were cast using samples having components shown in Table 3 and heat treated under conditions shown in Table 4. This time, as a casting mold for machinability test described below, a casting mold capable of obtaining a crude material of 20 mm×40 mm×2200 mm was adopted.

Moreover, Example 15 corresponds to Example 1 of Table 1, Example 16 corresponds to Example 13 of Table 1, Example 17 corresponds to Example 14 of Table 1, and Example 18 corresponds to Example 7 of Table 1. As the measurement results of the ferrite area ratio and thermal fatigue life, results of the corresponding Examples described above (see Table 1) were adopted and shown in Table 4 and FIG. 10.

<Machinability Test>

Figure 9:
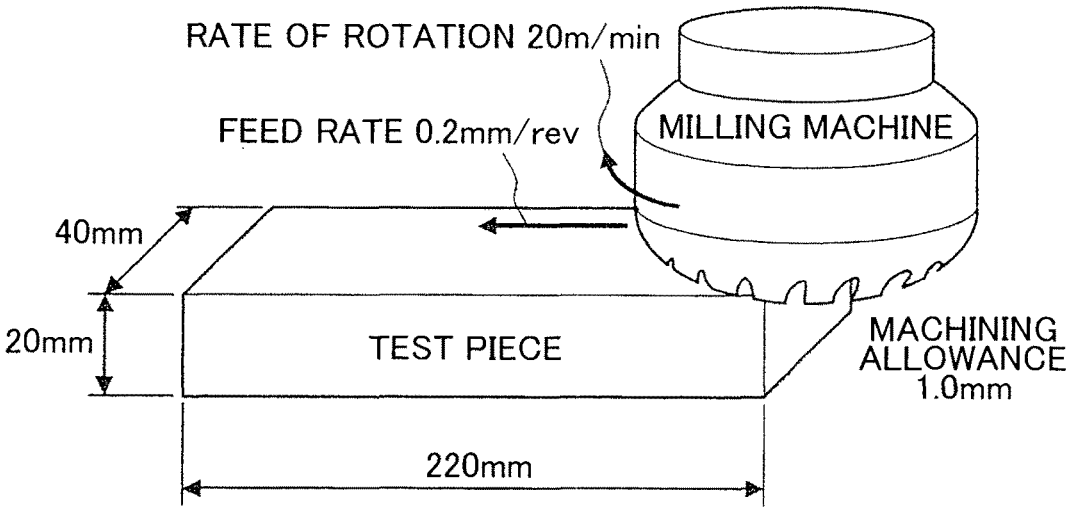
FIG. 9 is a schematic diagram for describing a machinability test.

The machinability test was conducted on test pieces according to Examples 15 to 18. Specifically, as shown in FIG. 9, a milling machine was set to a rate of rotation of 20 mm/min, a feed rate of 0.2 mm/rev, and a machining allowance of 1.0 mm, and the number of times by which an area of 40 mm×220 mm was machined was taken as one path. At this time, as evaluation of the machinability (lathe machinability), a flank wear amount of a milling machine in the number of work pieces (150 paths at the maximum paths) was measured. Results thereof are shown in FIG. 11.

Figure 11:
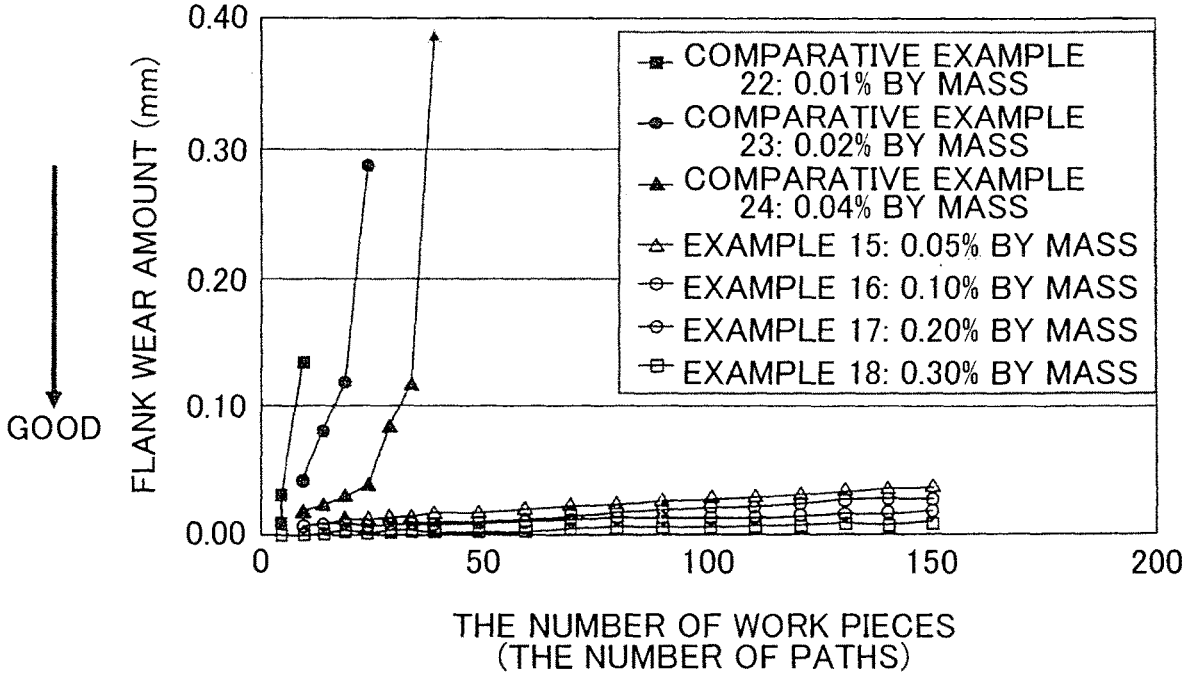
FIG. 11 is a chart that shows results of a flank wear amount of a milling cutter accompanying an increase in processing paths in a machinability test of the austenitic heat-resistant cast steels according to Examples 15 to 18 and Comparative Examples 22 to 24.

FIG. 11 is a diagram that shows results of flank wear amount of a milling machine accompanying an increase in the number of the processing path. In Examples 15 to 18, values at heating temperatures of 700° C. and 800° C. were hardly different from each other. Therefore, average values of these results are shown in FIG. 11. Further, in Table 4, cases where the flank wear amount at the number of paths of 100 paths is 0.1 mm or less are shown with OK, and cases where the flank wear amount exceeds 0.1 mm are shown with FAILED.

Comparative Examples 22 to 26

In the same manner as that of Example 1, test pieces made of austenitic heat-resistant cast steel were prepared. Specifically, the test pieces were cast with samples having components shown in Table 3 and heat treated under the heating condition shown in Table 4. In particular, Comparative Examples 22 to 24 were out of the range of the present invention in a point that the addition amount of S was set to less than 0.05% by mass, and Comparative Examples 25 and 26 were out of the range of the present invention in a point that the addition amount of S was set to more than 0.3% by mass.

The ferrite area ratios and thermal fatigue characteristics of the test pieces of Comparative Examples 22 to 26 were measured in the same manner as that conducted in Example 1. Further, the same machinability test as that conducted in Examples 15 to 18 was conducted on the test pieces of Comparative Examples 22 to 26.

TABLE 3

| (% by mass) | C | Si | Mn | P | S | Cr | Ni | N | Cu | Fe |
|---|---|---|---|---|---|---|---|---|---|---|
| Example 15 | 0.1 | 1.0 | 0.5 | 0.020 | 0.05 | 14 | 9 | 0.10 | 0 | Balance |
| Example 16 | 0.3 | 2.5 | 1.0 | 0.022 | 0.10 | 18 | 16 | 0.15 | 1 | Balance |
| Example 17 | 0.3 | 2.0 | 1.0 | 0.019 | 0.20 | 17 | 12 | 0.15 | 0 | Balance |
| Example 18 | 0.6 | 2.0 | 1.5 | 0.019 | 0.30 | 20 | 14 | 0.20 | 0 | Balance |
| Comparative Example 22 | 0.1 | 1.0 | 0.5 | 0.020 | 0.01 | 20 | 14 | 0.15 | 0 | Balance |
| Comparative Example 23 | 0.1 | 2.0 | 0.5 | 0.020 | 0.02 | 20 | 14 | 0.15 | 0 | Balance |
| Comparative Example 24 | 0.2 | 2.0 | 1.0 | 0.022 | 0.04 | 18 | 16 | 0.15 | 0 | Balance |
| Comparative Example 25 | 0.4 | 2.5 | 1.0 | 0.022 | 0.32 | 18 | 16 | 0.20 | 0 | Balance |
| Comparative Example 26 | 0.6 | 3.0 | 1.5 | 0.022 | 0.40 | 14 | 9 | 0.10 | 0 | Balance |

TABLE 4

| | Heating time period (Hrs) | Heating temperature (° C.) | Ferrite area ratio (%) | Fatigue life (hrs) | Machinability Lathe machinability evaluation (flank wear amount) 0.01 mm or less at 100 paths of work pieces |
|---|---|---|---|---|---|
| Example 15 | 20 | 700, 800 | 10 | 240 | OK |
| Example 16 | 20 | 700, 800 | 1 | 290 | OK |
| Example 17 | 20 | 700, 800 | 7 | 240 | OK |
| Example 18 | 20 | 700, 800 | 4 | 245 | OK |
| Comparative Example 22 | 20 | 700, 800 | 5 | 290 | FAILED |
| Comparative Example 23 | 20 | 700, 800 | 5 | 280 | FAILED |
| Comparative Example 24 | 20 | 700, 800 | 1 | 270 | FAILED |
| Comparative Example 25 | 20 | 700, 800 | 1 | 80 | OK |
| Comparative Example 26 | 20 | 700, 800 | 8 | 40 | OK |

[Result 6: On Addition Effect of S]

Figure 10:
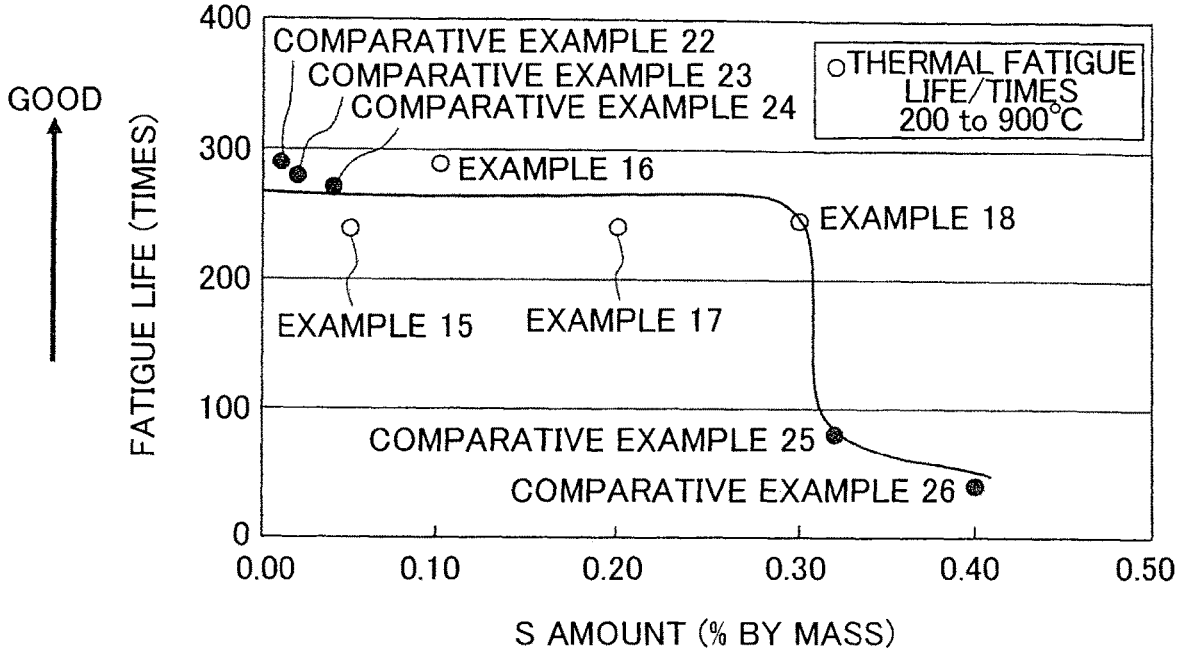
FIG. 10 is a chart that shows a relationship between added amounts of S of austenitic heat-resistant cast steels according to Examples 15 to 18 and Comparative Examples 22 to 26 and thermal fatigue lives thereof.

As shown in FIG. 10, when the addition amount of S exceeded 0.3% by mass like Comparative Examples 25 and 26, the thermal fatigue life degraded rapidly. This is considered because when the addition amount of S exceeded 0.3% by mass, S dissolved in a host phase.

On the other hand, as shown in FIG. 11, when the addition amount of S was less than 0.05% by mass like Comparative Examples 22 to 24, the flank wear amount of the milling machine was large and the machinability of the austenitic heat-resistant cast steel degraded. This is considered because an effect of good machinability due to MnS contained in the austenitic heat-resistant cast steel could not sufficiently be obtained when the addition amount of S was less than 0.05% by mass.

From such results, this is considered that when the addition amount of S is set to 0.05 to 0.3% by mass in the austenitic heat-resistant cast steel like in Embodiments, the machinability of the austenitic heat-resistant case steel can be improved and the thermal fatigue characteristics can be suppressed from degrading.

In the above, embodiments of the present invention were described in detail. However, the present invention is not limited to the embodiments described above and allows various design changes.

The invention claimed is:

1. An austenitic heat-resistant cast steel consisting of:
0.1% to 0.6% by mass of C,
1.0% to 3.0% by mass of Si,
0.5% to 1.5% by mass of Mn,
0.05% by mass or less of P,
0.05% to 0.3% by mass of S,
14% to 20% by mass of Cr,
9% to 16% by mass of Ni,
0.1% to 0.2% by mass of N,
optionally 1.0% to 3.0% by mass of Cu, and
the balance of iron and inevitable impurities,
wherein a matrix structure of the austenitic heat-resistant cast steel is composed of austenite crystal grains, a ferrite phase is dispersed and interposed between the austenite crystal grains so as to cover the austenite crystal grains, and an area ratio of the ferrite phase is in a range of 1 to 10% with respect to a whole structure of the austenitic heat-resistant cast steel.

2. The austenitic heat-resistant cast steel according to claim 1, wherein 1.0% to 3.0% by mass of Cu is present.

3. A method of manufacturing an austenitic heat-resistant cast steel comprising the steps of:

casting a cast steel from a molten metal consisting of 0.1% to 0.6% by mass of C, 1.0% to 3.0% by mass of Si, 0.5% to 1.5% by mass of Mn, 0.05% by mass or less of P, 0.05% to 0.3% by mass of S, 14% to 20% by mass of Cr, 9% to 16% by mass of Ni, 0.1% to 0.2% by mass of N, optionally 1.0% to 3.0% by mass of Cu, and the balance of iron and inevitable impurities; and heat treating the cast steel under heating conditions of a heating temperature of 700° C. to 800° C. and a heating time period of 20 to 300 hours to obtain the austenitic heat-resistant cast steel, wherein a matrix structure of the austenitic heat-resistant cast steel is composed of austenite crystal grains, a ferrite phase is dispersed and interposed between the austenite crystal grains so as to cover the austenite crystal grains, and an area ratio of the ferrite phase is in a range of 1 to 10% with respect to a whole structure of the austenitic heat-resistant cast steel.

4. The method of manufacturing an austenitic heat-resistant cast steel accordingly to claim 3, wherein the austenitic heat-resistant cast steel exhibits a thermal expansion coefficient of from 16.0 $K^{-1}$ to 16.2 $K^{-1}$, a tensile strength of 110 MPa to 142 MPa, and a fatigue life of 237 times to 295 times.

* * * * *